US005718058A

United States Patent [19]

Atzinger

[11] Patent Number: 5,718,058

[45] **Date of Patent: *Feb. 17, 1998**

[54] PROCESS AND APPARATUS FOR THE TRAVELING OF A PAPER TAIL FROM A FIRST TO A SECOND HANDLING STATION IN A PAPER MACHINE

[75] Inventor: Erlfried Atzinger, Appleton, Wis.

[73] Assignee: Voith Sulzer Papiermaschinen GmbH, Germany

[ * ] Notice: The term of this patent shall not extend beyond the expiration date of Pat. No. 5,600,897.

[21] Appl. No.: 751,243

[22] Filed: Nov. 18, 1996

Related U.S. Application Data

[63] Continuation of Ser. No. 386,007, Feb. 9, 1995, abandoned.

[51] Int. Cl.[6] ..... F26B 11/02

[52] U.S. Cl. ..... 34/117; 34/641; 34/643

[58] Field of Search ..... 34/114, 116, 117, 34/639, 641, 643

[56] References Cited

U.S. PATENT DOCUMENTS

| | | | |
|---|---|---|---|
| 1,595,477 | 8/1926 | Minton | 34/117 |
| 1,595,480 | 8/1926 | Minton | 34/117 |
| 3,514,372 | 5/1970 | Boyce et al. | 162/343 |
| 3,769,155 | 10/1973 | Schiel | 162/343 |
| 3,843,470 | 10/1974 | Betley et al. | 162/343 |
| 3,868,780 | 3/1975 | Soininen et al. | 34/116 |
| 4,543,162 | 9/1985 | Hildebrand | 162/343 |
| 4,945,655 | 8/1990 | Wedel | 34/23 |
| 5,101,577 | 4/1992 | Wedel | 34/114 |
| 5,232,554 | 8/1993 | Kotitschke | 162/193 |
| 5,283,960 | 2/1994 | Sims et al. | 34/117 |
| 5,321,899 | 6/1994 | Kade et al. | 34/114 |
| 5,416,980 | 5/1995 | Ilvespaa | 34/117 |
| 5,505,821 | 4/1996 | Meinecke et al. | 162/343 |
| 5,539,999 | 7/1996 | Lehosvuo et al. | 34/117 |
| 5,586,397 | 12/1996 | Kerttula et al. | 34/114 |
| 5,600,897 | 2/1997 | Sollinger et al. | 34/115 |

FOREIGN PATENT DOCUMENTS

| | | |
|---|---|---|
| 479748 | 4/1992 | European Pat. Off. . |
| 3941242 | 6/1991 | Germany . |
| 4328554 | 3/1994 | Germany . |
| 137061 | 6/1920 | United Kingdom . |
| 137061 | 6/1990 | United Kingdom . |

OTHER PUBLICATIONS

U.S. Patent Application Ser. No. 08/102,766, (corresponding to German reference 4328554).

*Primary Examiner*—Henry A. Bennett
*Assistant Examiner*—D. Doster
*Attorney, Agent, or Firm*—Ostrolenk, Faber, Gerb & Soffen, LLP

[57] ABSTRACT

In a drying section of a paper making machine, the paper web is conducted through a plurality of single tier dryer sections and then transferred to at least one final double tier dryer section for completing the drying process. The paper web is threaded through the open draw between the single tier dryer sections and the double tier dryer section and through the open draws between the lower cylinders and the upper cylinders in the double tier dryer section by use of air jets which blow at the paper web from opposite sides thereof. The air jets include at least one jet which blows in a direction generally opposite to that of the paper web.

6 Claims, 2 Drawing Sheets

OF
UF
S
9
17'
57'
57
54'
14
F
58
56
59
56'
16
59
53'
13
53
F
9
58
F
52
52'
12
55'
55
15
59
F
58
F
54
51
11
51'
9

PROCESS AND APPARATUS FOR THE TRAVELING OF A PAPER TAIL FROM A FIRST TO A SECOND HANDLING STATION IN A PAPER MACHINE

This is a Continuation of application Ser. No. 08/386,007 filed on Feb. 9, 1995, abandoned.

BACKGROUND OF THE INVENTION

The present invention relates to a method as well as a device for transferring a strip of paper, i.e. a paper web foil, from a first treatment station dryer section to a second treatment station in a paper machine. The following prior art is known:

(1) Federal Republic of Germany 43 28 554 A1

(2) Federal Republic of Germany 39 41 242 A1

Reference (1) shows and describes a dry end of a paper machine. This dry end has, in a first section, a single-row dryer group with a single felt. The felt, with the web resting on it, travels alternately over drying cylinders and guide suction rolls.

In a second section, the dry end has two rows of drying cylinders with two felts. In this case, the web travels alternately over the lower and upper cylinders.

Upon the starting i.e. threading, of the paper machine, a narrow edge strip (called a foil) is first passed through the entire dry end. Blast nozzles serve in this connection for the transfer of the foil from one drying cylinder to the other.

The blast nozzles produce air jets which extend substantially in the direction of transfer of the edge strip. The air jets thus drive the edge strip in the desired direction, namely from a first (upstream) drying cylinder to a second (downstream) drying cylinder in order to transfer the edge strip from the first drying cylinder to the second drying cylinder.

This transfer has always been a problem. It frequently was not possible to directly transfer the edge strip at given places. At times, there is a fluttering of the edge strip so that the entire process of the passing of the edge strip is time-consuming. This, however, means relatively long downtime of the paper machine, and thus a reduced production.

Reference (2) also shows and describes the transfer of a narrow edge strip in the dry end of a paper machine. In this case, a jet of air is produced which is directed opposite the direction of travel of the web of paper. However, this reference does not describe a free i.e. open draw transfer of the paper strip. Rather, the paper strip adheres to the outer surface of a cylinder and is scraped from the latter by a scraper, the blast air supporting the detachment.

The object of the present invention is to provide a method and a device for transferring a strip of paper from a first treatment station to a second treatment station, and particularly from a first drying cylinder to a second drying cylinder in order to permit the transfer with greater reliability and higher speed. This object is achieved by the inventions that re defined the method and; claims herein.

BRIEF DESCRIPTION OF THE DRAWINGS

The invention will be explained in further detail with reference to the drawing.

DETAILED DESCRIPTION

Figure 1:
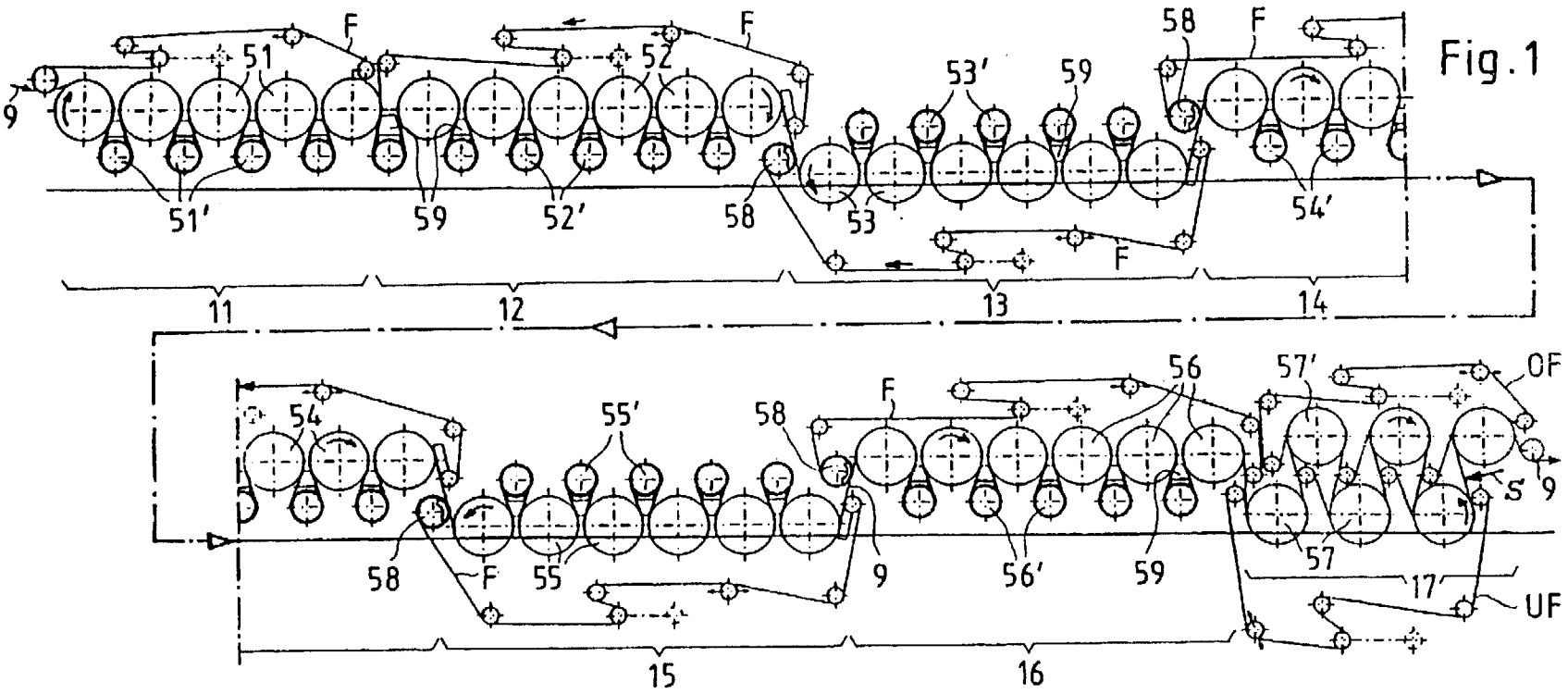
FIG. 1 shows a dry end with single-felt dryer groups 11–16 and a double-felt dryer group 17.

In FIG. 1 each of the single-felt dryer groups 11–16 has a single endless felt F. For instance, in the second dryer group 11, the felt travels together with the web 9 alternately over drying cylinders 51 and guide rolls 51', which are preferably developed as suction rolls. In the first two dryer groups 11 and 12, as well as in the fourth and sixth dryer groups 14, 16, the lower side of the web comes into contact with the cylinders. Accordingly, in this case, the drying cylinders 51, 52, 54, 56 lie above the corresponding guide suction rolls 51', 52', 54' and 56' respectively; the cylinders are in this case "top felted". This is different, however, in the third dryer group 13 and the fifth dryer group 15. Here, the cylinders 53, 55 come into contact with the top side of the web; they are therefore "bottom felted" and lie below the corresponding guide suction rolls 53', 55'. Accordingly, the places of separation between the drier groups 12 to 16 are developed as so-called reversal separating places. Details of these reversal separating places, described in European Patent Application P 43 11 351. It can be noted from FIG. 1 that, at each of these reversal separating places, the web of paper forms a short open path, i.e. an open draw path; that is, it is temporarily not supported by a felt. In the region of a small suction zone of a transfer roll 58, it travels onto the next felt in each case. In FIG. 1, these transfer rolls 58 are the sole suction rolls, with a stationary suction box within them. The guide suction rolls 51' to 56', on the other hand, are free of inner stationary inserts and of direct suction connections. Instead of this, an external suction box 59 is provided on each of these guide suction rolls. It lies in the so-called pocket present between two adjacent drying cylinders and is provided with a ledge 60 (see FIG. 7) which strips off the boundary layer of air carried along by the felt and deflects it, the ledge being provided at the place where felt F and web 9 together leave the first of said two cylinders.

The last single-felt dryer group 16 is followed by a double-felt dryer group 17 having several lower cylinders 57 and several upper cylinders 57', and having a lower felt UF and an upper felt OF. In this case, the web 9 travels in meandering path alternately over the lower and upper cylinders.

Figure 2:
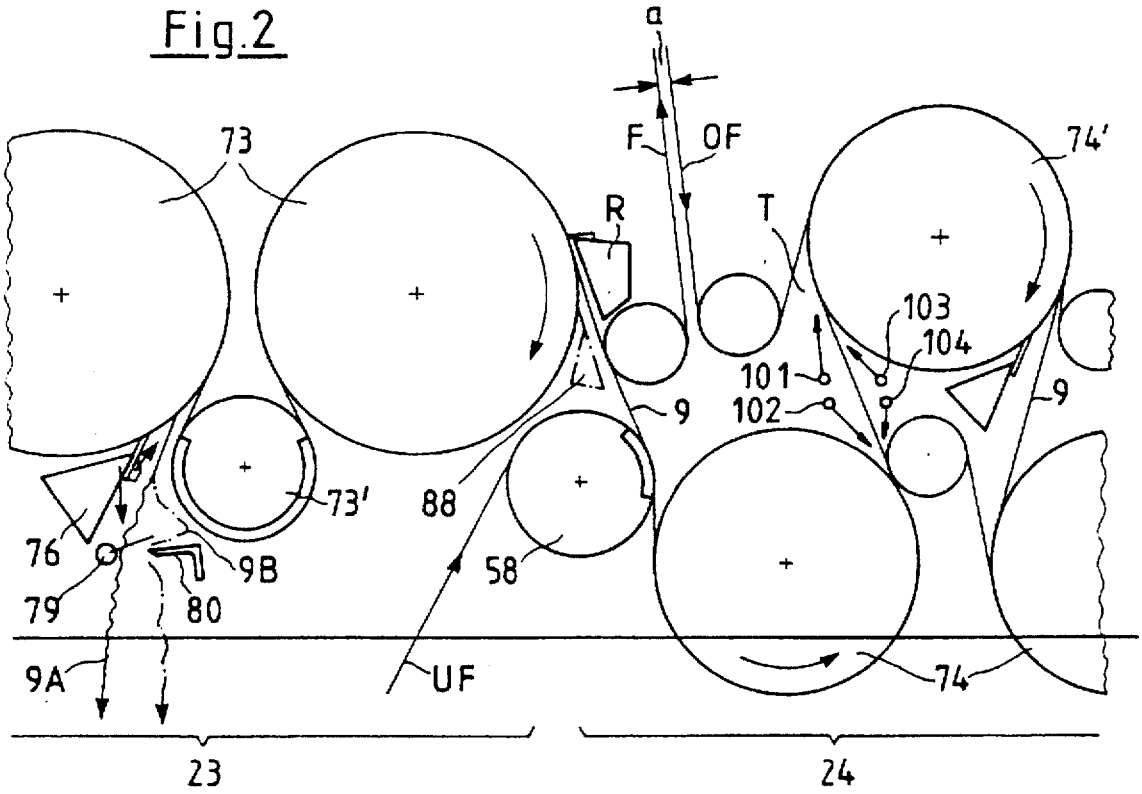
FIG. 2 is an enlargement of the web transfer region between dryer groups.

FIG. 2 shows, in the case of another dry end, the transfer region between the last single-felt dryer group and the first double-felt dryer group. There can be noted here the last two drying cylinders 73 of the last single-felt dryer group 23 and the first three cylinders 74, 74' of the double-felt dryer group 24. There can furthermore be noted a guide suction roll 73' provided with inner suction box and, in front of the first lower drying cylinder 74, a transverse suction roll 58, also having a stationary inner suction box. An automatic ropeless edge-strip guide device is formed in the single-felt dryer group 23, for instance in the manner that each guide suction roll 73 has a known edge-suction zone on one of its two ends. Furthermore, air-blast devices are provided on a scraper support body 76, which devices are indicated symbolically by arrows, as well as an air-blast nozzle 79. At the place where the web 9 and the felt F jointly leave the last cylinder 73, an edge suction box R (active only in the region of the edge strip), web stabilizer, or the like, can be arranged. Or, a short "edge-strip guide scraper" 88 which covers only the region of the edge strip and which may also have an air-blast nozzle, is arranged on the last cylinder 73.

The blast nozzles 101, 102, 103, 104 shown in FIG. 2 are absolutely decisive. They serve for the transferring of an edge strip from the first lower drying cylinder 74 of the double-felt dryer group 24 to the first upper drying cylinder 74' thereof. As can be seen, on both sides of the edge strip 9, there are blast nozzles 101, 103, the air jets of which are directed upward, i.e. in the direction of transfer, as well as blast nozzles 102, 104, the air jets of which are directed downward and thus opposite the direction of transfer. The inventor has found that, in this way, an extremely stable guiding of the edge strip is possible. The air jets of the nozzles 101, 102 produce a conveying action in that they rapidly carry the edge strip along in upward direction to the drying cylinder 74'. The air jets of the two blast nozzles 102, 104, on the other hand, see to it that the edge strip assumes a stable position and, immediately after leaving the first lower drying cylinder 74 of the dryer group 24, assumes the correct direction to the first upper drying cylinder 74'.

The two blast nozzles 101, 102, as well as the two blast nozzles 103, 104, can be structurally combined, being thus borne by a single bracket.

Figure 3:
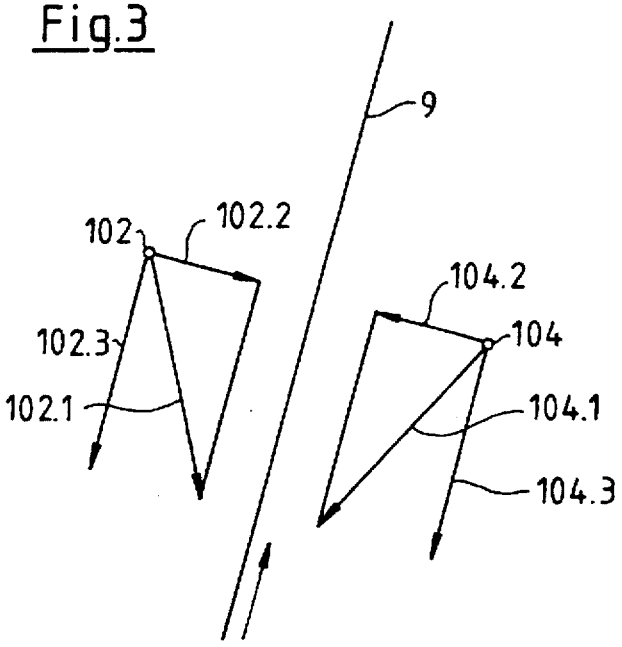
FIG. 3 graphically illustrates the transfer air jet directions in the web transfer regions.

In FIG. 3 the transfer region is again shown, on a larger scale. Again, the blast nozzles 102, 104 can be noted. The blast nozzles 101, 103 have been omitted for greater clarity of the drawing. As can be seen, air jet 102.1 from blast nozzle 102 has a component 102.2 which is perpendicular to the direction of the edge strip 9, and a component 102.3 which is exactly opposite to the direction of the edge strip 9. Exactly the same is true with respect to the air jets 104.1 from blast nozzle 104 having the components 104.2 and 104.3.

We claim:

1. A method for drying a paper web in a drying section, comprising the steps of:

a) providing a plurality of successively arranged dryer groups, each group including a plurality of heatable dryer cylinders which come into contact with the paper web;

b) conducting the paper web through a first, initial region of the dryer section, in which at least one of the dryer groups is configured as a single-felt dryer group in which a single endless felt and the paper web travel together meandering alternately over the dryer cylinders and over guide or transfer rolls;

c) thereafter conducting the paper web through a second region, at an end of the dryer section, directly or indirectly downstream of the single-felt dryer group which second region includes at least one double-felt dryer group in which the paper web travels meandering alternately over upper and lower drying cylinders, with an open draw of paper web being formed between each of the upper and lower cylinders;

d) threading a tail of the paper web through the at least one single-felt dryer group with an automatic ropeless tail guide device; and e) threading the tail with a further automatic ropeless tail guide device through the at least one double-felt dryer group; and f) directing first air jets at the paper web at at least one of the open draws to transfer the paper web across the open draw, the first air jets having air flow components flowing substantially in a direction opposite to that of the paper web, on opposed sides of the paper web.

2. The method of claim 1, in which the paper web is a tail being threaded through the drying section and the air jets are operated at least during threading of the tail.

3. The method of claim 1, further including providing second air jets which have flow components in the direction of the paper web path.

4. The method of claim 1, further including providing the first air jets on opposed sides of the paper web, so that the paper web is subjected to the first air jets from opposed sides thereof.

5. The method of claim 1, in which the flow direction of the first air jets is nearly precisely in a direction opposite to the direction of the paper web.

6. The method of claim 1, in which the first air jets have a first component of air flow directed opposite to the direction of the paper web path and a second component of air flow directed substantially perpendicularly to the direction of the paper web path.

* * * * *